US008666233B2

(12) United States Patent
Lee

(10) Patent No.: US 8,666,233 B2
(45) Date of Patent: Mar. 4, 2014

(54) GAS RANGE USABLE AS ELECTRIC RANGE

(76) Inventor: Ha-yong Lee, Gyeonggi-do (KR)

( * ) Notice: Subject to any disclaimer, the term of this patent is extended or adjusted under 35 U.S.C. 154(b) by 0 days.

(21) Appl. No.: 14/007,319

(22) PCT Filed: Mar. 12, 2012

(86) PCT No.: PCT/KR2012/001779

§ 371 (c)(1),
(2), (4) Date: Sep. 24, 2013

(87) PCT Pub. No.: WO2012/134076

PCT Pub. Date: Oct. 4, 2012

(65) Prior Publication Data

US 2014/0016916 A1 Jan. 16, 2014

(30) Foreign Application Priority Data

Mar. 25, 2011 (KR) ..... 10-2011-0027141

(51) Int. Cl.
*F24C 1/00* (2006.01)
*F24C 11/00* (2006.01)

(52) U.S. Cl.
USPC ..... 392/309; 392/307; 392/308

(58) Field of Classification Search
None
See application file for complete search history.

(56) References Cited

U.S. PATENT DOCUMENTS 1,406,850 A * 2/1922 Hadaway, Jr. ..... 392/309
1,716,329 A * 6/1929 Simpson ..... 392/309
2,304,302 A * 12/1942 Crupi ..... 392/309
2,658,987 A * 11/1953 Ogden ..... 392/309
4,541,407 A * 9/1985 Sommers et al. ..... 126/39 E
4,899,723 A * 2/1990 Pajares ..... 126/39 R
5,275,147 A * 1/1994 Aktinson, III ..... 126/39 BA
5,329,918 A * 7/1994 Di Bari ..... 126/39 BA
5,347,609 A * 9/1994 Huff ..... 392/309

FOREIGN PATENT DOCUMENTS

JP 08-312964 A 11/1996
KR 20-0322769 Y1 8/2003
KR 10-0701207 B1 4/2007
KR 10-2010-0012093 A 2/2010

* cited by examiner

*Primary Examiner* — Thor Campbell
(74) *Attorney, Agent, or Firm* — AKC Patents; Aliki K. Collins

(57) ABSTRACT

The present invention relates to a gas range usable as an electric range, wherein the simultaneous supply of gas and electricity can be prevented, and the replacement and use thereof are more convenient due to having a simple configuration. The present invention provides a gas range usable as an electric range, comprising: a burner portion at the inside of a case; and an accommodation portion for accommodating a gas container supplying gas to the burner portion, at one side, wherein a heating element placed at the corresponding position of the burner portion and a heating member comprising a body coupled to one side of the heating element are coupled in a separable manner inside the case and the accommodation portion. Therefore, since it is possible to mount a portable gas container and/or a heating member to the accommodation portion, gas and electricity are not simultaneously supplied, thereby preventing the occurrence of fire, and the configuration of the heating member is simple, thereby allowing the replacement of a portable gas container and use thereof to be convenient.

2 Claims, 4 Drawing Sheets

GAS RANGE USABLE AS ELECTRIC RANGE

CROSS-REFERENCE TO RELATED APPLICATION

This application claims the benefit of Korean Patent Application No. 10-2011-0027141, filed on Mar. 25, 2011 in the Korean Intellectual Property Office, the disclosure of which is incorporated herein by reference.

TECHNICAL FIELD

The present invention relates to a portable range that can cook using gas or electricity, and more particularly, to a gas range usable as an electric range in which gas and electricity are not simultaneously supplied and that has a simple structure and that can be simply replaced and used.

BACKGROUND ART

In general, a portable range is defined to a gas range using a small-sized bombe filled with a butane gas. Because cook is performed using a combustion heat of a gas in a home or indoor in which electricity is supplied, there is a problem that indoor air is contaminated.

In order to solve the problem, a gas range usable as an electric range was suggested. A conventional gas range usable as an electric range (Korean Utility Model Laid-Open Publication No. 96-5693) in which a gas can eject a flame through an ejecting nozzle by a gas container housed in a gas container receiving chamber of one side of a body and in which a container supporting plate is disposed in an upper portion of the body, wherein at an outer circumferential side of a flame ejecting nozzle of the range, a heating plate having a heat emitting wire therein is installed, and a supporting plate is fixed by a support to correspond to a bottom surface of the heating plate, and at one side of a partitioning wall of the gas container receiving chamber, an outlet is detachably installed and is connected to the heat emitting wire of the heating plate.

Such a conventional gas range usable as an electric range is formed to cook using one of electricity and gas according to a situation, but there is a problem that the range may break down and a fire may occur in the range when electricity and gas are simultaneously supplied.

DISCLOSURE

Technical Problem

The present invention has been made in view of the above problems, and provides a gas range usable as an electric range having no worry of a failure or fire by preventing gas and electricity from being simultaneously supplied.

The present invention further provides a gas range usable as an electric range that can be simply replaced and used with a simple structure.

Technical Solution

In accordance with an aspect of the present invention, there is a gas range usable as an electric range in which a burner portion is provided at the inside of a case and that has a receiving portion in which a gas container that supplies a gas to the burner portion is received at one side thereof, wherein within the case and the receiving portion, a heat emitting member formed with a heating element positioned at a corresponding position of the burner portion to emit a heat and a body coupled to one side of the heating element is detachably coupled.

Advantageous Effects

In a gas range usable as an electric range according to the present invention, because only one of a portable gas container and a heat emitting member can be mounted in a receiving portion, gas and electricity are not simultaneously supplied, thereby preventing fire.

Further, because a heat emitting member has a simple structure, there is a merit that the heat emitting member can be simply replaced and used with a portable gas container.

BEST MODES FOR CARRYING OUT THE INVENTION

Hereinafter, an exemplary embodiment of the present invention will be described in detail with reference to the accompanying drawings.

Figure 1:
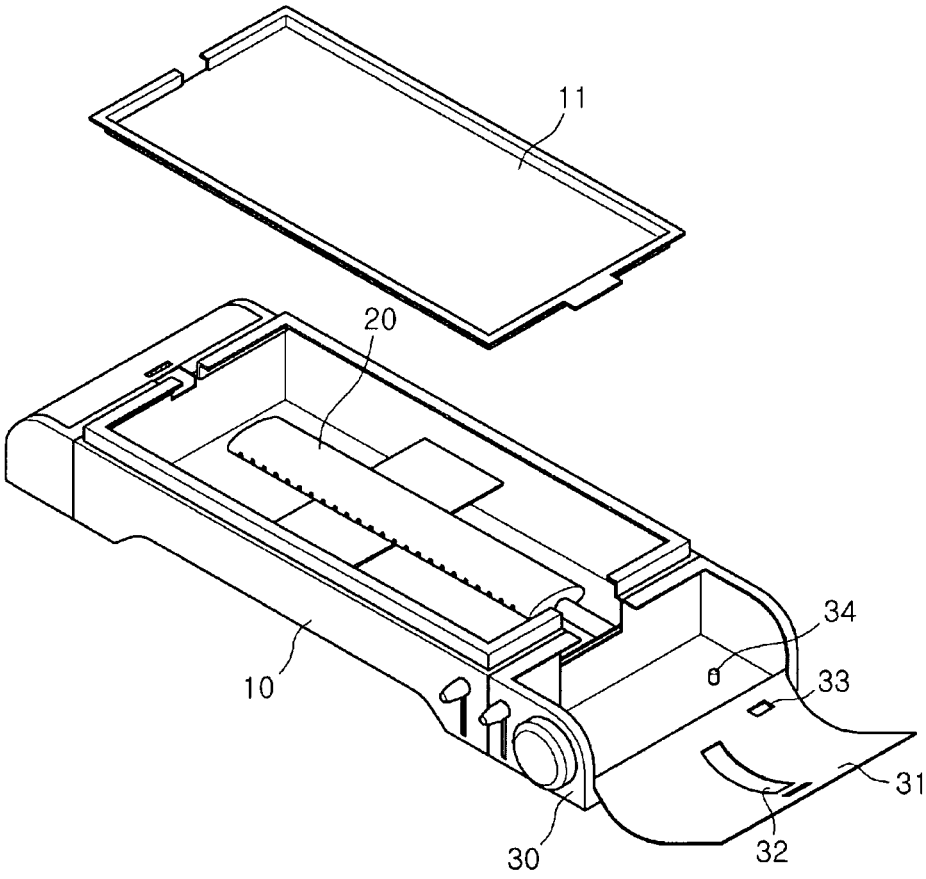
FIG. 1 is a perspective view illustrating a gas range usable as an electric range using a gas according to an exemplary embodiment of the present invention.
Figure 2:
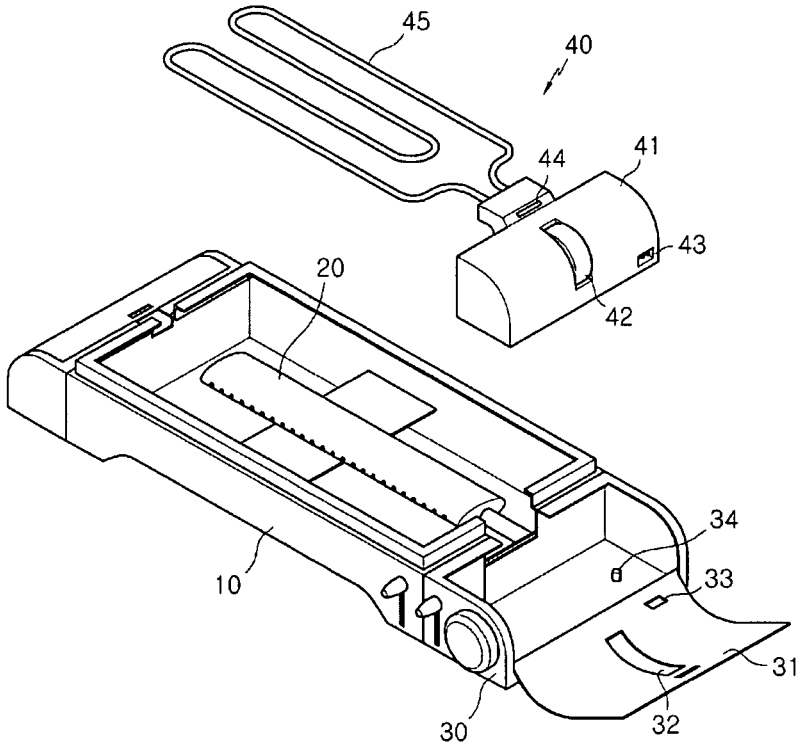
FIG. 2 is a perspective view illustrating a gas range usable as an electric range using electricity by coupling a heat emitting member according to an exemplary embodiment of the present invention.

A gas range usable as an electric range according to an exemplary embodiment of the present invention is formed to cook using gas or electricity, as shown in FIGS. 1 and 2.

As shown in FIG. 1, at the inside of a case 10, a burner portion 20 is provided, and a flame ignited in the burner portion 20 heats a cooking plate 11, and at one side of the burner portion 20, a receiving portion 30 that houses a gas container is provided.

At the receiving portion 30, a fixing lever that fixes a portable gas container and an ignition switch are provided, and a cover 31 coupled to one side of the receiving portion 30 is opened, and at the inside thereof, a portable gas container is coupled and used.

FIG. 2 is a perspective view illustrating a case in which a gas range usable as an electric range uses electricity, and a heat emitting member 40 is coupled to the inside of the receiving portion 30 or a heat emitting member 40 is detachably coupled to the inside of the receiving portion 30.

At one side of the heat emitting member 40, a body 41 to be inserted into the inside of the receiving portion 30 is provided, and in a central portion of the body 41, a voltage adjusting unit 42 that can adjust a temperature by adjusting a voltage is formed.

Further, in a lower portion of the body 41, a connecting portion 43 is formed to supply power to the heat emitting member 40 by connecting to a power supply code, and in an upper portion of the body 41, a display unit 44 formed with light-emitting diodes (LED) and for displaying to determine an on or off state of power by the naked eye is formed.

First and second cutout portions 32 and 33 are formed at positions corresponding to the voltage adjustment member 42 and the connecting portion 43, respectively, of a cover 31 and can adjust the voltage adjustment member 42, and a power supply code may be connected to the connecting portion 43.

At the other side of the body 41, i.e., in an upper portion of the burner portion 20, a heating element 45 that is installed at the inside of the case 10 and that emits a heat when power is supplied is formed.

Figure 3:
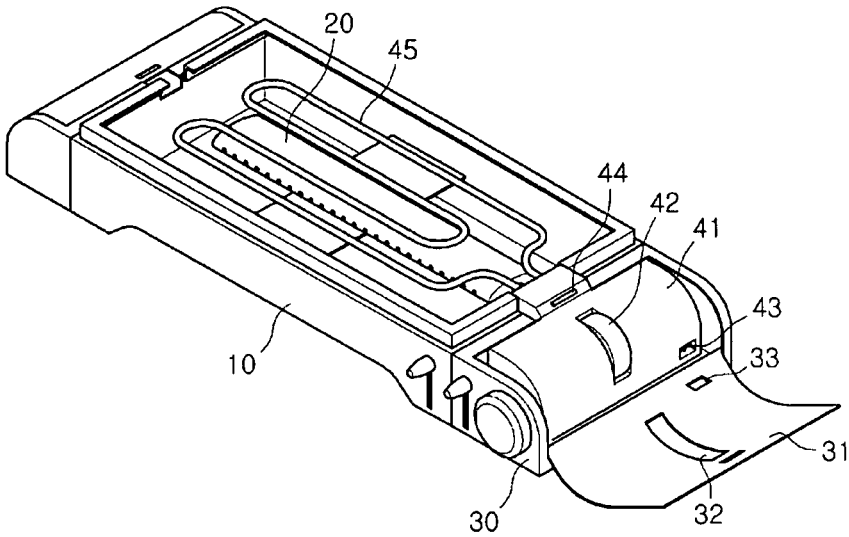
FIG. 3 is a perspective view illustrating a state in which a heat emitting member is coupled to a gas range usable as an electric range according to an exemplary embodiment of the present invention.

As shown in FIG. 3, by opening the cover 31 of the receiving portion 30 and by inserting the body 41 into the inside, the heat emitting member 40 formed in this way is simply installed, and thus the heating element 45 is positioned at the inside of the case 10, i.e., in an upper portion of the burner portion 20, thereby heating a cooking plate 11.

Figure 4:
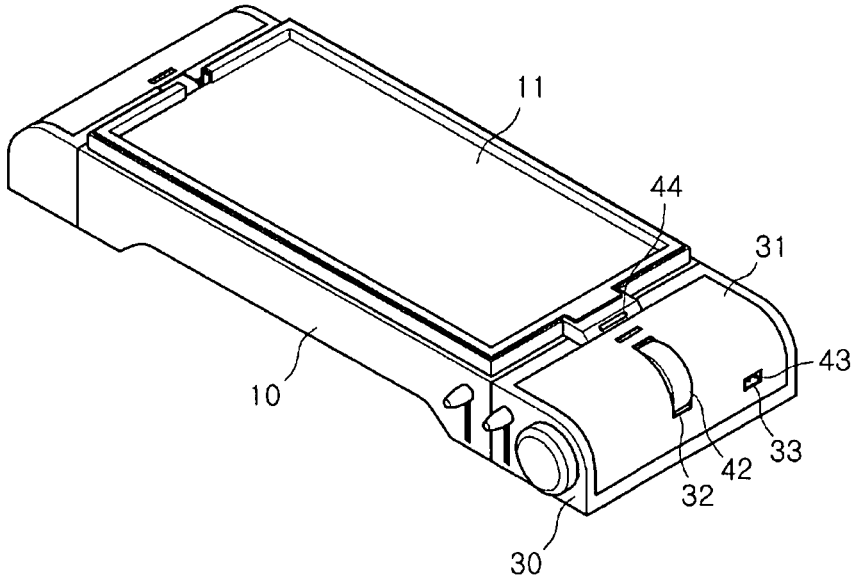
FIG. 4 is a perspective view illustrating a case in which a gas range usable as an electric range uses electricity according to an exemplary embodiment of the present invention.

After the heat emitting member 40 is inserted into the inside of the receiving portion 30, when the cover 31 is closed, as shown in FIG. 4, the protruded voltage adjusting unit 42 can be manipulated through the first cutout portion 32 formed in the cover 31, and a power supply code may be connected to the exposed connecting portion 43 through the second cutout portion 33.

The heat emitting member 40 enables to automatically maintain an appropriate temperature by an on and off repetition operation according to a preset temperature by applying a bimetal switch that emits a heat when a voltage and a current of a predetermined value or more are supplied, thereby preventing overheating.

In this case, a power supply control operation by a bimetal corresponds to the conventional well-known art and therefore a detailed description thereof will be omitted.

Only when the heat emitting member 40 according to an exemplary embodiment of the present invention is accurately mounted in the receiving portion 30 for safety, the heat emitting member 40 receives power supply to emit a heat.

Figure 5:
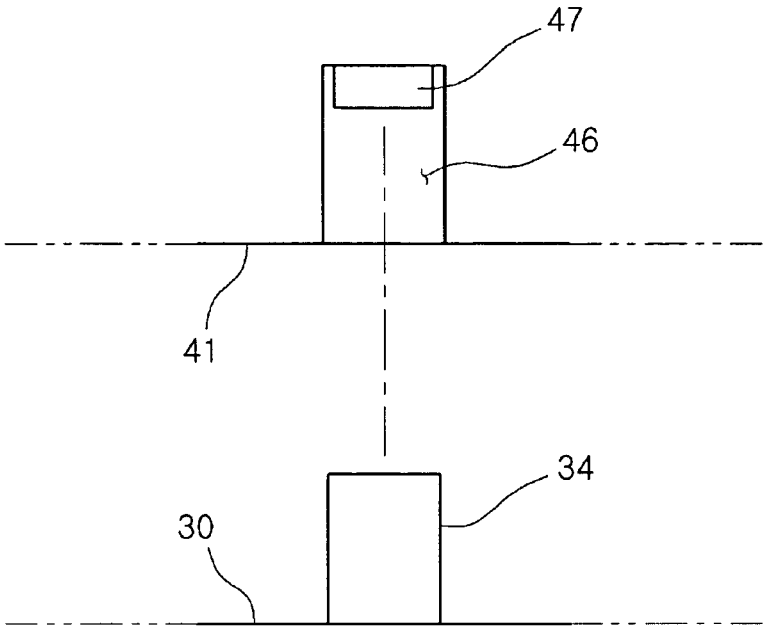
FIG. 5 is a schematic diagram illustrating a process in which a button of a heat emitting member close contacts with a protruded portion of a receiving portion according to an exemplary embodiment of the present invention.

For this purpose, as shown in FIG. 5, at a bottom surface of the receiving portion 30, a protruded portion 34 is protruded, and within an insertion hole 46 formed at a bottom surface of the heat emitting member 40, a button switch 47 for applying power when being pressed by the protruded portion 34 is provided.

That is, the button switch 47 selectively applies power supplied to the heating element 45, and only when the protruded portion 34 applies a pressure to the button switch 47, the button switch 47 enables external power to be applied to the inside and thus only in a state in which the heat emitting member 40 is accurately disposed within the receiving portion 30, the heating element 45 emits a heat by power applied through the connecting portion 43.

In a range according to an exemplary embodiment of the present invention formed in this way, when a gas container is inserted into the receiving portion 30 and the gas container is coupled to the receiving portion 30, and when a gas exhausted from the burner portion 20 is ignited, the cooking plate 11 of an upper portion thereof is heated and thus food is cooked.

Further, when using electricity, after separating the gas container coupled within the receiving portion 30, the heat emitting member 40 is coupled within the receiving portion 30, and after a power supply code is connected to the connecting portion 43, when manipulating the voltage adjusting unit 42, the heating element 45 emits a heat and thus the cooking plate 11 of an upper portion thereof is heated.

In this case, as the protruded portion 34 protruded into the receiving portion 30 applies a pressure to the button switch 47 formed in a bottom surface of the body 41, power is applied and thus complete coupling is performed.

Further, when the gas container is coupled within the receiving portion 30, the heat emitting member 40 is in a separated state, and when the heat emitting member 40 is coupled within the receiving portion 30, the gas container is in a separated state and thus the burner portion 20 and the heating element 45 do not simultaneously operate and thus the range maintains a very safe state.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A stove convertible to between a gas mode and an electric mode, the stove comprising:

a case having first and second spaces formed therein, the first and second spaces being adjacent to each other, the first space accommodating a gas burner and the second space accommodating a gas container to supply a gas to the gas burner;

an electric heating member coupled to the case in the electric mode and separated from the case in the gas mode respectively;

a cover configured to close or open the second space;

wherein the electric heating member comprises a body configured to be received in the second space in place of the gas container in the electric mode; a heating element horizontally extending from the body so as to be configured to be received in the first space in the electric mode; a voltage adjustment unit disposed at a middle region of the body to adjust a heating temperature of the heating element; an electric connection unit disposed at a lower region of the body so as to be configured to be electrically connected to an external power supply; and an indication unit disposed at an upper region of the body and having a light emitting device so as to indicate turn-on or off states of the electric heating member;

wherein the cover comprises a first cutout through which the voltage adjustment unit protrudes outwardly in a closing state thereof, and a second cutout through which the connection unit protrudes outwardly in a closing state thereof; and wherein in the electric mode, the gas container is replaced with the body of the electric heating member in the second space.

2. The stove of claim 1, wherein the case has a protrusion on a bottom thereof and the electric heating member has a button disposed at a bottom of the body, wherein when the electric heating member is coupled to the case and the protrusion presses the button, the electric heating member turns on.

* * * * *